United States Patent [19]

Carlson

[11] 3,963,252

[45] June 15, 1976

[54] ROLLER SKATE

[76] Inventor: Ronald G. Carlson, 9524 Otis, Apt. A, South Gate, Calif. 90280

[22] Filed: Oct. 21, 1974

[21] Appl. No.: 516,595

Related U.S. Application Data

[63] Continuation-in-part of Ser. No. 373,642, June 26, 1973, abandoned, which is a continuation-in-part of Ser. No. 149,908, June 4, 1971, abandoned.

[52] U.S. Cl. ..... 280/11.22; 280/11.26; 280/11.28

[51] Int. Cl.[2] ..... A63C 17/06; A63C 1/26

[58] Field of Search ..... 280/11.22, 11.23, 11.3, 280/11.26, 11.28, 11.19

[56] References Cited

UNITED STATES PATENTS

| | | | |
|---|---|---|---|
| 1,609,612 | 12/1926 | Eskeland | 280/11.22 |
| 1,733,059 | 10/1929 | Grinnen | 280/11.23 |
| 1,801,205 | 4/1931 | Mirick | 280/11.22 |
| 2,021,435 | 11/1935 | Smith | 280/11.26 |
| 2,168,820 | 8/1939 | Edstrom | 280/11.23 |
| 2,644,692 | 7/1953 | Kahlert | 280/11.22 |
| 2,679,401 | 5/1954 | Williams | 280/11.23 |
| 2,927,798 | 3/1960 | Jones et al. | 280/11.26 |
| 3,396,985 | 8/1968 | Kipnis | 280/11.26 |

*Primary Examiner*—M. H. Wood, Jr .
*Assistant Examiner*—Milton L. Smith
*Attorney, Agent, or Firm*—Boniard I. Brown

[57] ABSTRACT

A roller skate having a frame mounting heel and toe sections which are independently adjustable to accommodate different foot and shoe sizes and wheels having spring supported axles whose ends are releasably positioned in slots in the frame in such a way as to permit rapid removal and replacement of the wheels. The heel section has a rigid ankle support and the toe section has a rigid toe receiving portion which are uniquely constructed and arranged to permit the skate to be worn safely with or without shoes.

12 Claims, 10 Drawing Figures

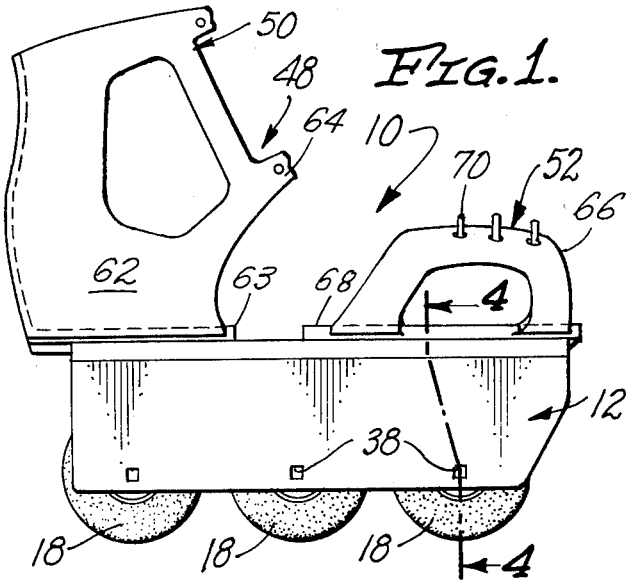
FIG. 1.
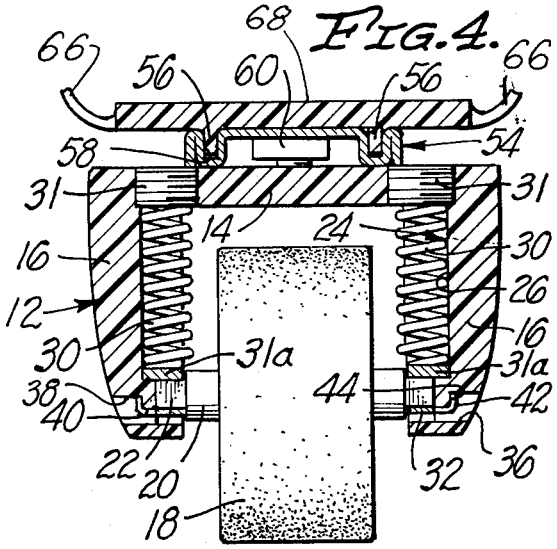
FIG. 4.
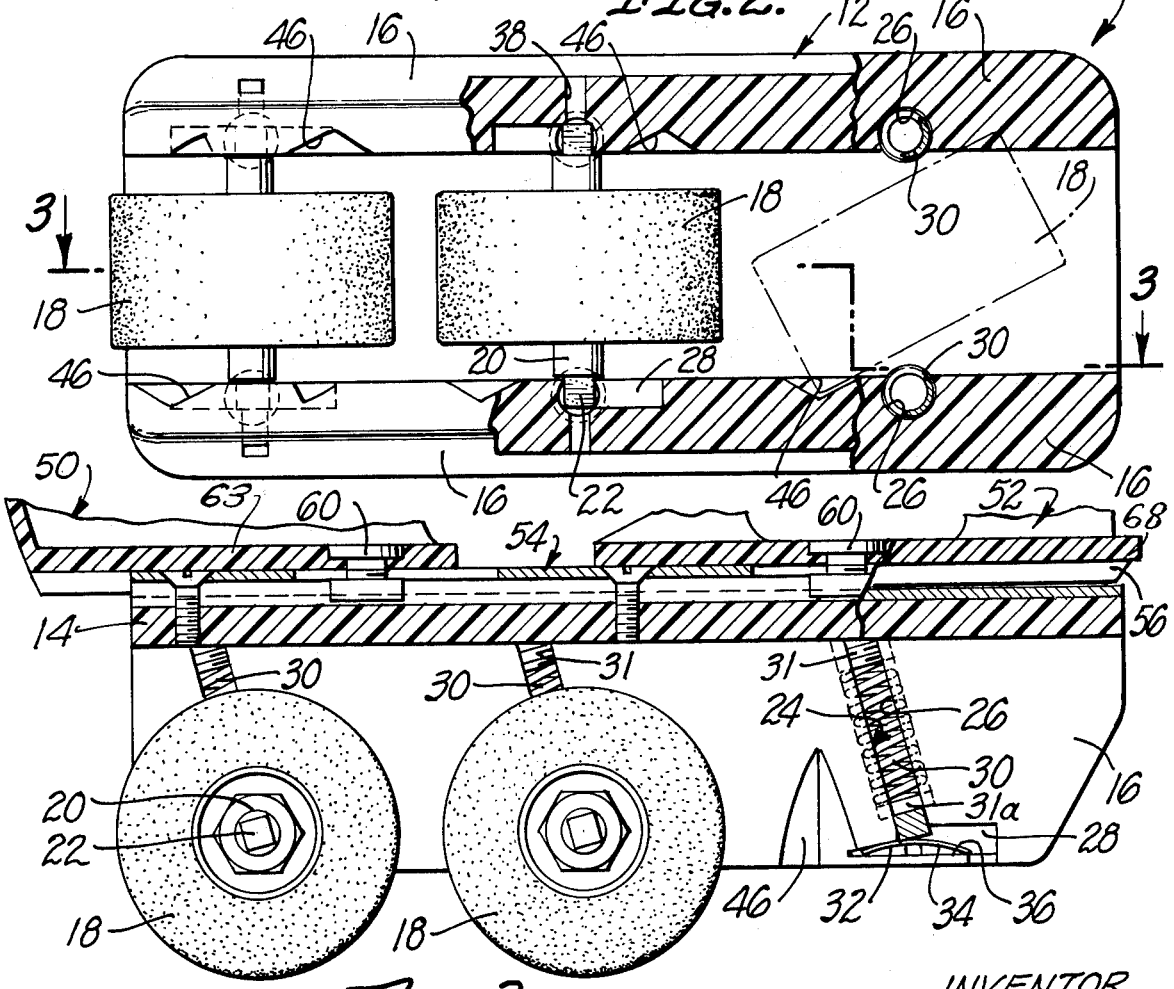
FIG. 2.
FIG. 3.
INVENTOR
RONALD G. CARLSON
BY
Bernard S. Brown
ATTORNEY INVENTOR
RONALD G. CARLSON
BY
Bernard A. Brown
ATTORNEY FIG. 7.
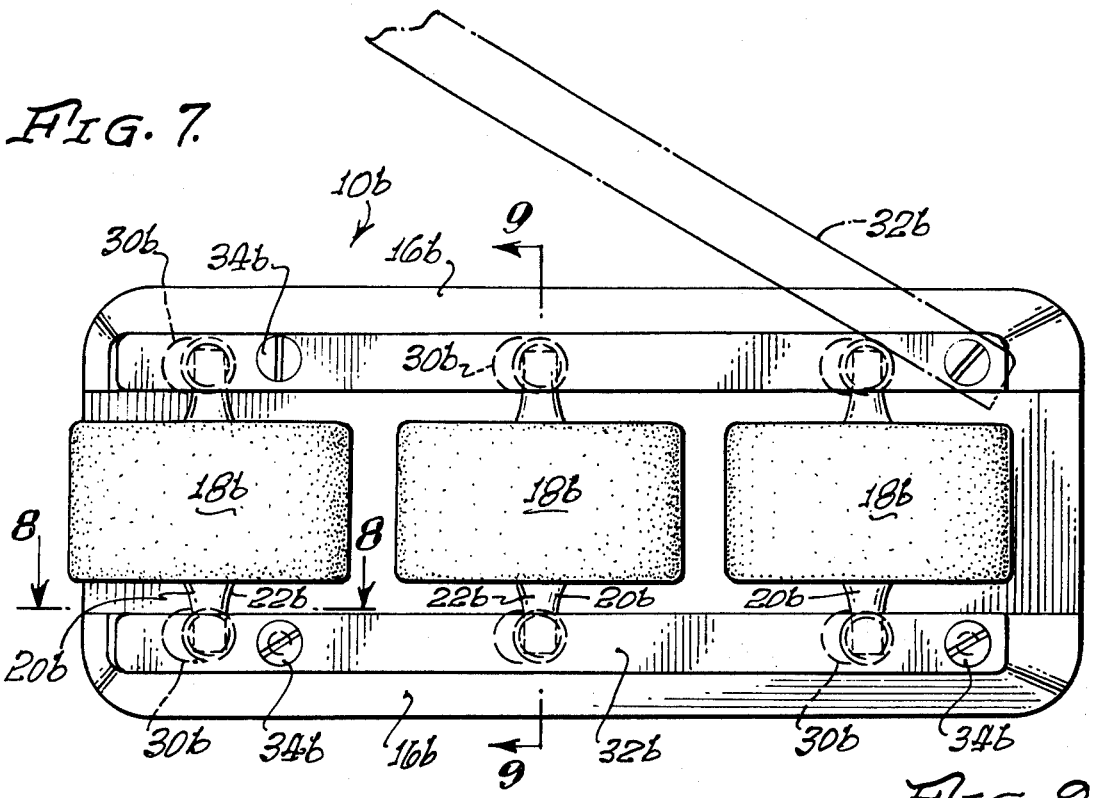
FIG. 8.
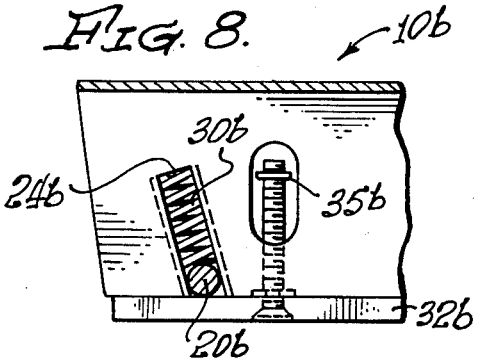
FIG. 9.
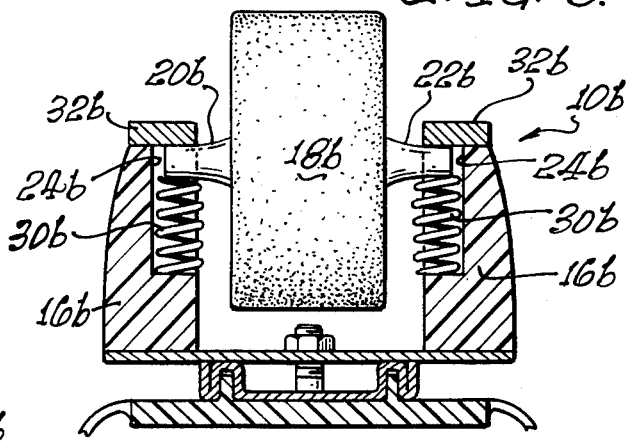
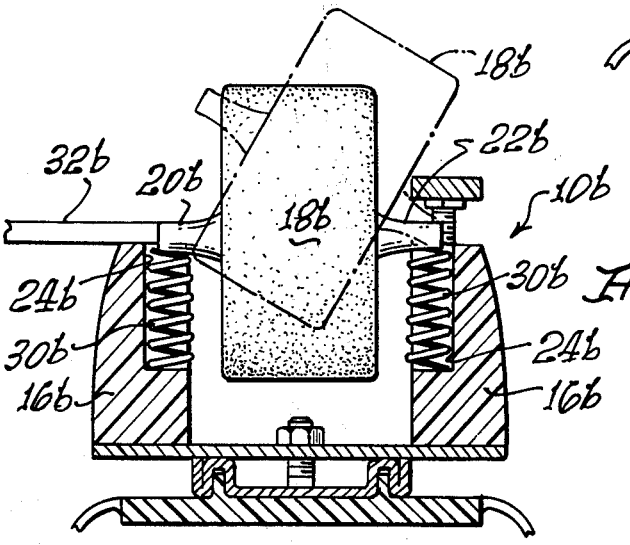
FIG. 10.

ROLLER SKATE

RELATED APPLICATIONS

This application is a continuation-in-part of application Ser. No. 373,642, filed June 26, 1973, which, in turn, is a contination-in-part of application Ser. No. 149,908, filed June 4, 1971, both now abandoned.

BACKGROUND OF THE INVENTION

1. Field of the Invention

This invention relates generally to the field of amusement devices and more particularly to novel roller skates.

2. Discussion of the Prior Art

Roller skating has long been a favorite form of amusement and recreation for children and teenagers. As a result, a wide assortment of roller skates have been devised. These roller skates have been equipped with different types of wheels, depending upon the type of surface on which the skates are to be used. For example, conventional children's skates intended for outdoor use are commonly provided with metal wheels, while skates intended for indoor use are provided with rubber or non-metallic wheels.

The existing roller skates have not been designed with the aim of permitting the individual user to install different types of wheels on his skates. As a consequence, there has been no attempt to construct the wheel mounting means of roller skates in such a way as to permit easy removal and replacement of the wheels or to provide replacement wheel sets for roller skates. By way of example, U.S. Pat. No. 1,609,612 and 2,664,692 illustrate two types of existing roller skate wheel mounts. The difficulty of removing and replacing conventional roller skate wheels also deters users from repairing or replacing worn or damaged wheels with the result that roller skates are often prematurely discarded because of a worn or damaged wheel.

Some roller skates, generally the less costly skates, such as children's outdoor skates, are arranged to be worn over street shoes, while the more costly skates, such as indoor skates, are provided with boots for receiving the user's feet. These latter skates are not adjustable to accommodate a wide range of foot sizes. On the other hand, roller skates which are worn over street shoes, while generally adjustable to accommodate a relatively wide range of shoe sizes, often come loose from the shoes and thus present a serious safety hazard. Moreover, skates of this latter kind also tend to mar or indent the wearer's shoes.

SUMMARY OF THE INVENTION

The present invention provides a roller skate construction characterized by wheels which may be quickly and easily removed and replaced by the user without the use of tools and by an improved means for adjusting the skate to fit a wide range of street shoe sizes. Quick and easy wheel removal and replacement is accomplished by providing the skate with a channel shaped frame having depending side flanges between which are located the skate wheels. Each wheel is rotatably mounted on an axle whose ends engage in slots in the inner surfaces of the frame flanges. These slots contain springs which bias the wheel axles to the lower ends of the slots to provide a spring suspension of the frame on the wheels. In one disclosed embodiment, the slots have upright portions containing the compression springs and lateral portions at the lower ends of the upright portions. Normally, the ends of each wheel axle are retained in the lower ends of the upright slot portions by retainer springs which are located in the lower lateral slot portions and bear against the undersides of the axle ends. In this normal wheel position, the skate frame is supported on the roller wheel axles through the compression springs. These springs serve to cushion the shocks occasioned by movement of the wheels across cracks, bumps, and the like. According to a feature of the invention, the upright slot portions and their contained compression springs incline forwardly in the direction of their lower ends in order to improve the cushioning action of the springs.

Each wheel is quickly and easily removable from the frame by first moving the wheel axle downwardly in its upright frame slot portions, against the upward thrust of its retainer springs, to positions wherein the axle ends are located in their lower lateral slot portions. The axle is then rotated or twisted about a central vertical transverse axis of the axle to move the axle ends along the lateral slot portions until they clear the frame flanges sufficiently for removal of the axle and its wheel from the frame. In another disclosed embodiment, the lower ends of the frame slots are closed by members which are movable to uncover the slot ends in order to remove and insert the wheel axles through the lower slot ends. Such wheel removal and replacement may be for the purpose of replacing one type of wheel by another, such as a metal outdoor wheel by a rubber indoor wheel, or for the purpose of repairing or replacing a damaged or worn wheel.

Another aspect of the invention is concerned with the upper foot receiving means of the skate which are uniquely constructed and arranged to permit the skate to be worn with or without shoes as well as adjusted to to accommodate different shoe and foot sizes. According to this feature skate is provided with heel and toe sections which are slidably secured to the upper wall of the skate frame for individual adjustment of either or both sections to accommodate a wide range of shoe and foot sizes. The heel section includes a relatively high and stiff heel and ankle support and the toe section a relatively rigid toe receiving portion which are designed to permit the skate to be safely worn with or without shoes and with virtually no danger of an ankle sprain or the skate coming loose from the wearer's foot or shoe. According to the preferred practice of the invention, the ankle support and toe receiving portion of the skate are injection molded from plastic.

BRIEF DESCRIPTION OF THE DRAWINGS

FIG. 1 is a side elevation of a roller skate according to the invention;

FIG. 2 is an enlarged bottom view of the skate with parts in section;

FIG. 3 is a section taken on line 3—3 in FIG. 2;

FIG. 4 is an enlarged section taken on line 4—4 in FIG. 1;

FIG. 7 is a bottom view of the further modified skate similar to that of FIGS. 5 and 6;

FIG. 8 is a section taken on line 8—8 in FIG. 7;

FIG. 9 is a section taken on line 9—9 in FIG. 7; and

FIG. 10 is a section similar to FIG. 9 illustrating the manner of wheel removal.

DESCRIPTION OF THE PREFERRED EMBODIMENT

Figure 5:
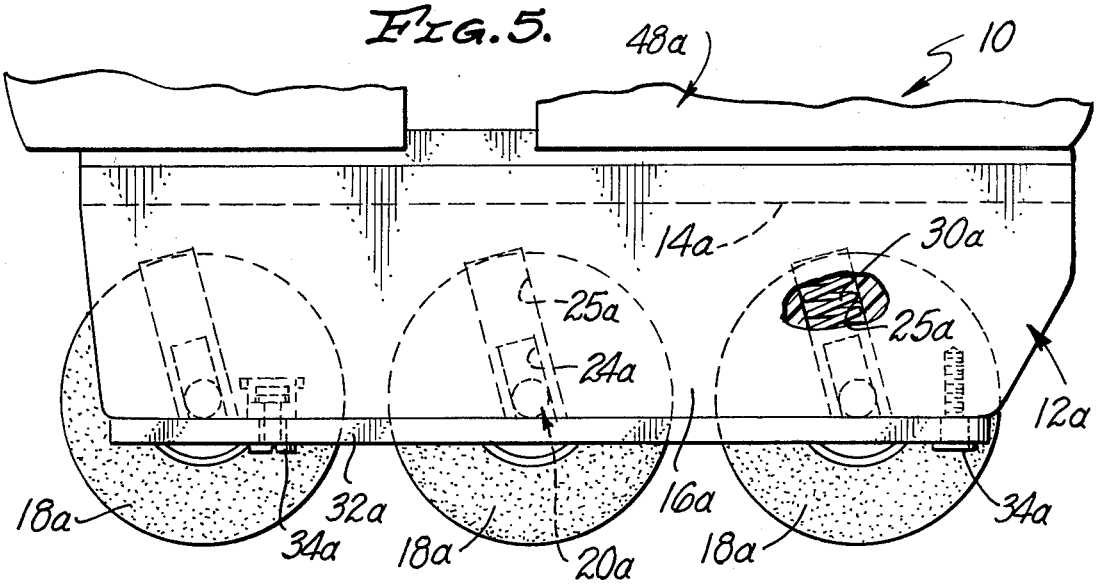
FIG. 5 is a side elevation of a modified skate.

The roller skate 10 of the invention selected for illustration in FIGS. 1–4 has a generally channel shaped frame 12 which may be molded from plastic, or otherwise fabricated from any suitable material. Frame 12 has an upper normally generally horizontal wall 14 and depending flanges 16 along the longitudinal edges of the wall. Between the flanges 16 are a number of wheels 18 rotatably supported on axles 20 having reduced ends 22.

The ends 22 of each wheel axle 20 engage in slots 24 in the inner surfaces of the frame flanges 16. Each slot 24 has an upper, generally upright portion 26 extending transverse to the upper frame wall 14 and the lower edges of the frame flanges 16 and a lateral portion 28 at the lower end of the upright portion, parallel to the frame wall and lower flange edges. Preferably, the upright slot portions 26 incline forwardly in the direction of their lower ends for reasons to be explained presently. The upright slot portions 26 are sized to receive the axle ends 22 with a relatively close sliding fit, such that the axles may move up and down freely in the latter slot portions.

Contained within the upper slot portions 26 are compression coil springs 30. These springs seat at their upper ends against threaded plugs 31 which are removable to insert and remove the springs and at their lower ends against washers 31*a* which bear against the axle ends 22. As shown best in FIG. 2, the upright slot portions 26 are cylindrically enlarged to contain or captivate the springs 30 and have reduced open sides which open through the inner frame flange surfaces to slidably receive the axle ends 22.

Within each lateral slot portion 28, below the corresponding upright slot portion 26, is a retainer spring 32. This retainer spring has an upwardly convex arcuate portion 34 which seats at its ends downwardly against the lower wall 36 of the respective lateral slot portion 28 and at its center upwardly against the adjacent axle end 22. Extending laterally from the arcuate spring portion 34 through an opening 38 in the frame flange 16 is an arm 40 terminating in an upwardly directed flange 42 which engages a shoulder 44 on the frame flange to secure the retainer spring 32 in position.

The retainer springs 32 are stronger than the compression springs 30 and normally retain the wheel axle ends 22 within the lower ends of the upright slot portions 26, as shown in FIGS. 3 and 4. In these positions, the axles 20 are free to move up and down in the slot portions 26, against and with the bias of the springs 30 but are restrained against lateral movement in the fore and aft direction of the skate frame 12. When the wheels 18 rest on the ground, the frame is supported on the wheels through the springs 30 which thus provide a spring suspension for the frame.

Each wheel 18 and its axle 20 is removable from the frame 12 by moving the axle downwardly in its upright slot portions 26, against the upward bias of its retainer springs 32, to a position wherein the axle ends 22 are located within their lateral slot portions 28. The wheel and axle are then twisted or rotated about a vertical transverse axis, as shown in broken lines in FIG. 2, to move the axle ends along the lateral slot portions until the ends clear the frame flanges for removal of the wheel and axle through the lower open side of the frame 12. In connection with this twisting of the wheel and axle, it will be observed that the lateral slot portions 28 for each axle 20 extend in opposite lateral directions from their upright slot portions 26, such that the axle can be twisted and disengaged as described. The spacing between the frame flanges 16 is such that it is necessary to recess the inner flange surfaces at 46 to provide clearance for each wheel 18, whereby the latter may rotate through a sufficient angle to disengage its axle from the frame flanges. Reassembly of the wheels and axles on the frame is accomplished by reversing the wheel removal procedure explained above.

Atop the upper frame wall 14 are means 48 for securing the skate to the wearer's foot or shoe. In this regard, it will be recalled from the earlier discussion that the present skate is designed to be worn safely with or without shoes. Means 48 include heel and toe sections 50, 52 slidably supported on a track 54 secured to the upper frame wall 14 and having depending ribs 56 which slide within grooves or channels 58 in the track 54. From this description, it will be understood that the heel and toe sections 50, 52 are independently adjustable in the fore and aft direction of the skate frame 12 to vary the spacing between the sections and thereby accommodate the skate to a range of foot and shoe sizes. The sections are secured in adjusted positions by fasteners 60 which extend through the slots in the track 54.

The heel section 50 comprises a relatively high and stiff though somewhat flexible ankle support or brace 62 which surrounds the rear and sides of the wearer's foot from its sole to a point some distance above the ankle. The lower end of this brace is joined to a heel plate 63 having the ribs 56 at its under side. Along one front edge of the ankle support are straps 64 (only portions of which are shown) having free ends (not shown) adapted to be fastened by buckles or the like (not shown) to the opposite side of the ankle support for firmly securing the support to and drawing the support tightly about the wearer's ankle. Laces may be used in place of straps, of course. The toe section 52 comprises a toe receiving portion including a pair of relative stiff though somewhat flexible side wings 66 joined along their lower edges to a sole plate 68 having the ribs 56 at its under side. The upper edges of the wings 66 are joined by laces 70 which may be drawn tight and tied to one another to draw the toe portion 52 firmly about the wearer's foot. Laces 70 could be replaced by straps, of course. According to the preferred practice of the invention, the ankle support 50 and toe portion 52 are injection molded from a suitable plastic.

In use, the wearer's foot or shoe is secured in the ankle support and toe portion 50, 52 after the latter are properly adjusted to the correct foot or shoe size. It will be understood, of course, that one skate is placed on each foot. The ankle support and toe receiving portion are made sufficiently stiff to reinforce the wearer's foot and particularly his ankle against sprain or other injury and are shaped for wearing comfort even when shoes are not worn. During rolling movement of the wheels 18 along the ground, the wheel axle springs 30 yield to cushion shocks occasioned by cracks, bumps and the like. In this regard, it is significant to note that the forward slope of the axle slots 26 and springs 30 enhance the cushioning action of the springs. The illustrated wheel arrangement of three wheels in tandem also provides for smoother movement of the skate along the normal skating surfaces.

When desired, the skate wheels 18 may be quickly and easily removed and replaced in the manner explained earlier. This wheel removal and replacement may be for the purpose of repairing or replacing a worn or damaged wheel or replacing one type of wheel by another, such as metal outdoor wheels for rubber indoor wheels, or vice versa.

Figure 6:
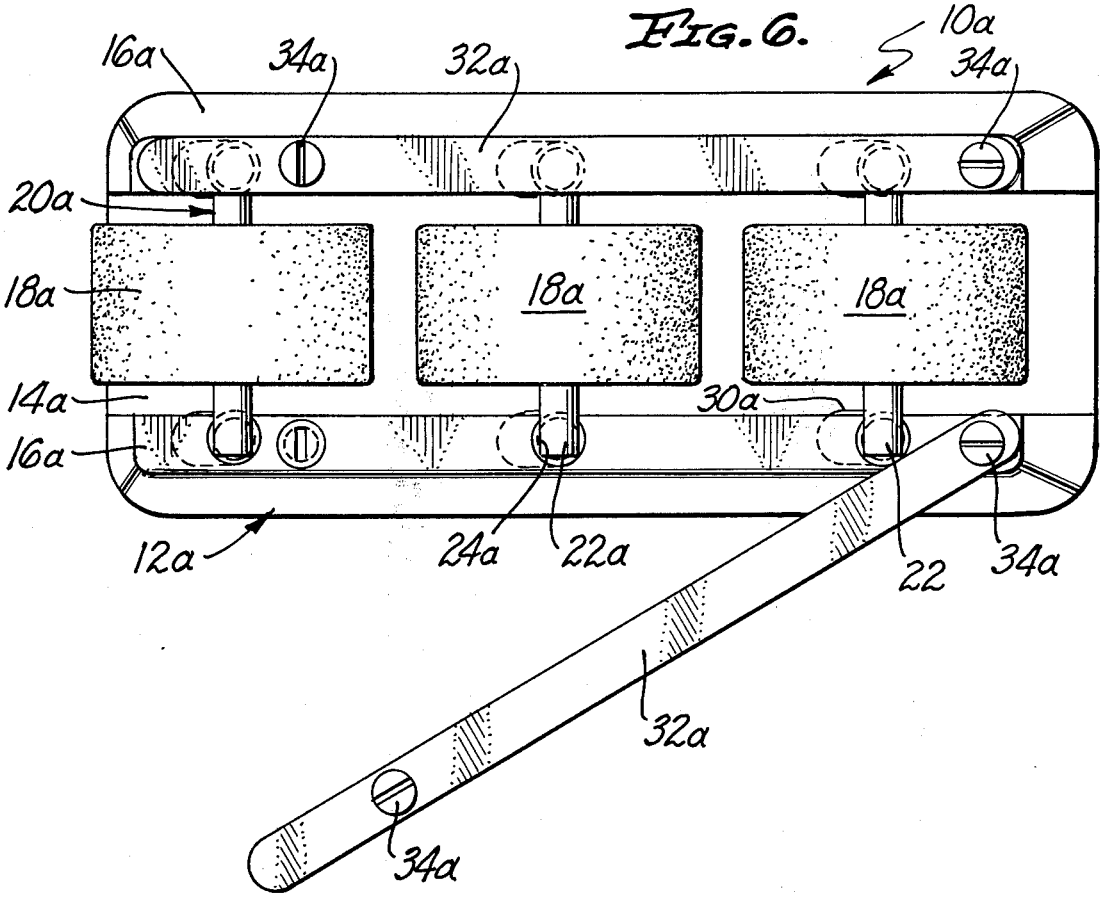
FIG. 6 is a bottom view of the modified skate illustrating the manner of wheel removal and insertion.

The modified roller skate 10*a* of FIGS. 5 and 6 is generally similar to that of FIGS. 1–4 and has a channel-shaped frame 12*a* with an upper wall 14*a* and depending flanges 16*a*. Atop the frame wall 14*a* are means 48*a* for receiving the wearer's foot. Between the flanges 16*a* are wheels 18*a* having axles 20*a*. The ends 22*a* of each wheel axle 20*a* slide in inclined slots 24*a* in the frame flanges 16*a*. Slots 24*a* open upwardly to generally cylindrical cavities or bores 25*a* above the upper ends of the slots. All of the slots 24*a* open downwardly through the lower edges of the frame flanges 16*a*. Contained within the communicating slots 24*a* and bores 25*a* are compression springs 30*a* which seat at their upper ends against the upper end walls of the bores and at their lower ends against the adjacent axle ends 22*a*.

The lower ends of the slots 24*a* are closed by retainer members 32*a* which are removably secured to the bottom edges of the frame flanges 16*a*. In this case, the retainer members 32*a* are strips or bars secured to the flanges by releasable fasteners 34*a*. The right hand fasteners in FIGS. 5 and 6 are shoulder screws which pivotally attach the bars to the frame flanges. The left hand fasteners are quick release fasteners, such as bayonet fasteners which are rotatable 90° to lock and release.

Normally the retainer members or bars 32*a* overlie the lower ends of the slots 24*a* to retain the wheel axles 20*a* and springs 30*a* in position in the flanges. The wheels are removable from and replaceable in the frame, for the reasons stated earlier, by releasing the left hand retainer fasteners 34*a* and swinging the retainer bars 32*a* clear of the frame flanges 16*a*, as shown in FIG. 6.

The modified skate 10*b* of FIGS. 7–10 is similar to that of FIGS. 5 and 6 and includes wheels 18*b* with axles 20*b* having tapered ends 22*b* fitting within inclined slots 24*b* in the skate frame flanges 16*b*. Slots 24*b* contain springs 30*b* for urging the axle ends downwardly in their slots. The lower open ends of these slots are closed by retainer members or bars 32*b*. Retainer bars 32*b* are secured to the frame flanges 16*b* by retainer fasteners 34*b*.

The upper retainer bar 32*b* in FIG. 7 is pivotally attached to its frame flange 16*b* in the same manner as the retainer bars 32*a* in FIGS. 5 and 6, such that the bar 32*b* is swingable to its broken line position of FIG. 7 to uncover the lower ends of its frame slots 24*b*. The lower retainer bar 32*b* in FIG. 7 is attached to its frame flange 16*b* by fasteners 34*b* comprising screws with retaining collars or shoulders 35*b*. These collars secure the screws against axial movement relative to the retainer bars and against axial removal from the frame flange. Normally, the lower bar is firmly secured against the lower edge of its flange by the screws to retain the adjacent ends 22*b* of the wheel axles 20*b* in their frame flange slots 24*b*, as shown in FIGS. 8 and 9.

Removal of the wheels 18*b* is accomplished by releasing and swinging the upper retainer bar 32*b* in FIG. 7 to its broken line position and unthreading the lower retainer bar screws 34*b* to separate the lower bar from its frame flange 16*b*, as shown in FIG. 10. Each wheel is then removed by rotating the wheel axle to elevate its upper end in FIG. 7 from its flange slot 24*b* and then moving the wheel axially away from the frame flange 16*b* in FIG. 10 to withdraw the opposite end of the axle from its flange slot, as shown in the latter figure. Assembly of the wheel on the skate is accomplished by reversing this procedure.

The inventor claims:

1. A roller skate comprising:

a channel shaped frame having an upper normally generally horizontal wall mounting foot receiving means, depending flanges along the longitudinal edges of the wall, wheels between said flanges each including an axle having ends engaging in slots entering the inner surfaces and opening longitudinally through the bottom edges of said flanges, compression springs in said slots above said axle ends for yieldably urging said axles downwardly in the slots, said slots entering the inner surface of said flanges to a depth less than the thickness of said flanges, whereby said flanges position said axles endwise, retainer bars extending along said bottom edges and overlying the lower open ends of said slots for releasably retaining said axles in their slots, and means securing said retainer bars to said flanges for movement of the bars to and from axle retaining positions, wherein the bars close the lower ends of said slots to retain the wheel axles in the slots as well as to permit removal and replacement of said wheels.

2. A roller skate according to claim 1 wherein:

said retainer bar securing means comprise pivot means securing one end of each retainer bar to its respective flange for swinging of the bar to and from its axle retaining position, means for releasably securing the bar in said retaining position, whereby each wheel is removable and replaceable by lateral movement of its axle ends through its open lower slot ends.

3. A roller skate according to claim 1 wherein:

the securing means for one retainer bar comprises screws for moving said one bar laterally toward and away from the bottom edge of its flange, whereby each wheel is removable by moving the other retainer bar from its axle retaining position to uncover the flange slot containing the adjacent end of the respective wheel axle, rotating the wheel axle to move said adjacent axle end through the lower open end of its slot, and moving the wheel and axle in the axial direction away from the other axle end to withdraw the latter end from its slot.

4. A roller skate according to claim 3 wherein:

the securing means for said other retainer bar comprises pivot means securing one end of said other retainer bar to its respective flange for swinging of the bar to and from its axle retaining position, and means for releasably securing said other bar in said retaining position.

5. A roller skate according to claim 1 wherein:

said springs are coil springs, and said slots are generally circular in cross-section and of greater than 180° circumferential extent, whereby said springs are captivated in said slots.

6. A roller skate according to claim 1 wherein:

said foot receiving means comprise heel and toe receiving members, and means for independently adjusting the receiving members along said frame wall.

7. A roller skate according to claim 6 wherein:

said adjusting means comprises a guide secured to the upper side of said wall, interengaging longitudinal tongue and groove means on said receiving members guiding said receiving members for longitudinal movement along said frame, and means for releasably securing said receiving members in adjusted position.

8. A roller skate comprising:

a channel shaped frame having an upper normally generally horizontal wall mounting foot receiving means, depending flanges along the longitudinal edges of the wall, wheels between said flanges each including an axle having ends engaging in slots in the inner surfaces of said flanges, said slots for each axle having upper parallel upright portions transverse to said wall and opening at their lower ends to lower slot portions extending laterally of said upper slot portions, retainer springs in said lateral slot portions below said upright slot portions for yieldably retaining the ends of each axle in their upright slot portions, compression springs in said upright slot portions for urging said axles downwardly into contact with their retainer springs, each axle being movable downwardly aganst the thrust of its retainer springs to a position wherein its ends are located in their lateral slot portions to permit rotation of the axle about a transverse axis normal to said wall to a position of disengagement of its ends from their lateral slot portions for removal of the axle and its wheel from said frame.

9. A roller skate according to claim 8 wherein:

the space between said flanges is just slightly wider than said wheels, and the inner surfaces of said flanges have recesses to clear said wheels for rotation with their axles to disengage the axles from said flanges.

10. A roller skate according to claim 9 wherein:

said lateral slot portions for each axle extend in opposite lateral directions of their respective upright slot portions, and said clearance recesses for each wheel are located at opposite sides of the corresponding upright slot portions.

11. A roller skate comprising:

a frame having a top wall extending substantially the full length of said skate, wheels mounted on the under side of said frame, heel and toe receiving sections on the upper side of said frame, and means mounting said heel and toe sections on said frame for independent adjustment along said frame comprising a track at the upper side of and extending lengthwise of said top frame wall, fastening means rigidly securing said track to said wall, tongue and groove means on said track and sections guiding said sections for relative movement along said track, and means for releasably securing said sections in adjusted positions relative to said track.

12. A roller skate according to claim 11 wherein:

said track has longitudinal upwardly opening grooves, said heel section comprises a unitary molded plastic shape including a sole plate resting slidably on said track and having tongues slidable in said track grooves, a relatively high and stiff angle support for surrounding the rear and sides of the wearer's foot to a point above the ankle and means for drawing said support tightly about the wearer's ankle, and said toe receiving section comprises a unitary molded plastic shape including a sole plate resting slidably on said track and having tongues slidable in said track grooves, a toe receiving portion including relatively stiff wings at the sides of said portion for receiving therebetween the toe portion of the wearer's foot and means for drawing said wings toward one another and tightly about the toe portion of the wearer's foot.

* * * * *